US007976644B2

(12) United States Patent
Ushigami et al.

(10) Patent No.: US 7,976,644 B2
(45) Date of Patent: Jul. 12, 2011

(54) METHOD OF PRODUCTION OF GRAIN-ORIENTED ELECTRICAL STEEL SHEET WITH HIGH MAGNETIC FLUX DENSITY

(75) Inventors: Yoshiyuki Ushigami, Tokyo (JP); Norikazu Fujii, Tokyo (JP); Takeshi Kimura, Tokyo (JP); Maremizu Ishibashi, Tokyo (JP); Shuichi Nakamura, Tokyo (JP); Koji Yamasaki, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 261 days.

(21) Appl. No.: 12/227,319

(22) PCT Filed: May 22, 2007

(86) PCT No.: PCT/JP2007/060752

§ 371 (c)(1),
(2), (4) Date: Nov. 12, 2008

(87) PCT Pub. No.: WO2007/136127

PCT Pub. Date: Nov. 29, 2007

(65) Prior Publication Data

US 2009/0165895 A1 Jul. 2, 2009

(30) Foreign Application Priority Data

May 24, 2006 (JP) ..... 2006-143885

(51) Int. Cl.
*H01F 1/147* (2006.01)

(52) U.S. Cl. ..... 148/111; 148/308

(58) Field of Classification Search ..... None
See application file for complete search history.

(56) References Cited

FOREIGN PATENT DOCUMENTS

| | | | |
|---|---|---|---|
| EP | 1179603 | | 2/2002 |
| JP | 62-040315 | | 2/1987 |
| JP | 02-077525 | | 3/1990 |
| JP | 02-182866 | | 7/1990 |
| JP | 09-256051 | | 9/1997 |
| JP | 9-296219 | | 11/1997 |
| JP | 11-181524 | | 7/1999 |
| JP | 2000-178648 | | 6/2000 |
| JP | 2001-152250 | * | 6/2001 |
| JP | 2002-060842 | | 2/2002 |
| JP | 2003-3215 | | 1/2003 |

(Continued)

OTHER PUBLICATIONS

Machine Transaltion of JP 2001-152250.*
Machine Transaltion of Jp 2002-060842.*

(Continued)

*Primary Examiner* — John P Sheehan
(74) *Attorney, Agent, or Firm* — Kenyon & Kenyon LLP

(57) ABSTRACT

The present invention provides a method of production of grain-oriented electrical steel sheet comprising making a slab heating temperature 1280° C. or less, annealing hot rolled sheet by (a) a process of heating it to a predetermined temperature of 1000 to 1150° C. to cause recrystallization, then annealing by a temperature lower than that of 850 to 1100° C. or by (b) decarburizing in annealing the hot rolled sheet so that a difference in amounts of carbon of the steel sheet before and after annealing the hot rolled sheet becomes 0.002 to 0.02 mass % and performing the heating in the temperature elevation process of the decarburization annealing under conditions of a heating rate of 40° C. or more, preferably 75 to 125° C./s while the temperature of the steel sheet is in a range from 550° C. to 720° C. and utilizing induction heating for rapid heating in the temperature elevation process of decarburization annealing.

16 Claims, 5 Drawing Sheets

FOREIGN PATENT DOCUMENTS

| | | |
|---|---|---|
| JP | 2003-268450 | 9/2003 |
| JP | 2005-226111 | 8/2005 |

OTHER PUBLICATIONS

Ushigami et al., "Precipitation Behaviors of Injected Nitride Inhibitors during Secondary Recrystallization Annealing in Grain Oriented Silicon Steel," *Materials Science Forum*, vol. 204-206 (1996), pp. 593-598.

International Search Report dated Sep. 4, 2007 issued in corresponding PCT Application No. PCT/JP2007/060752.

* cited by examiner

METHOD OF PRODUCTION OF GRAIN-ORIENTED ELECTRICAL STEEL SHEET WITH HIGH MAGNETIC FLUX DENSITY

TECHNICAL FIELD

The present invention relates to a method of producing grain-oriented electrical steel sheet able to be used as a soft magnetic material for a core of a transformer or other electrical equipment by low temperature slab heating.

BACKGROUND ART

Grain-oriented electrical steel sheet is a steel sheet containing not more than 7% Si comprising crystal grains aligned in the {110}<001> orientation. Control of the crystal orientation in the production of such grain-oriented electrical steel sheet is realized utilizing the catastrophic grain growth phenomenon called "secondary recrystallization".

As one method for controlling this secondary recrystallization, the method of completely dissolving a coarse precipitates at the time of heating a slab before hot rolling, then forming finely precipitate called an "inhibitor" in the hot rolling and the subsequent annealing process is being industrially practiced. With this method, to cause the precipitate to completely dissolve, it is necessary to heat the slab to a high temperature of 1350° C. to 1400° C. or more. This temperature is about 200° C. higher than the slab heating temperature of ordinary steel. A special heating furnace is therefore necessary for this. Further, there are the problems that the amount of the molten scale is large etc.

Therefore, R&D on the production of grain-oriented electrical steel sheet by low temperature slab heating have been carried out.

As the method for production of low temperature slab heating, for example Komatsu et al. disclose the method of using (Al,Si)N formed by nitridation as the inhibitor in Japanese Patent Publication (B2) No. 62-45285. Further, Kobayashi et al. disclose as the method of nitridation at that time the method of nitridation in a strip form after decarburization annealing in Japanese Patent Publication (A) No. 2-77525. The present inventors reported on the behavior of nitrides in the case of nitridation in a strip form in "Materials Science Forum", 204-206 (1996), pp. 593-598.

Further, the inventors showed that in such a method of production of grain-oriented electrical steel sheet by low temperature slab heating, no inhibitor is formed at the time of decarburization annealing, so adjustment of the primary recrystallized structure in the decarburization annealing is important for the control of secondary recrystallization and that if the coefficient of variation of the distribution of grain size in the primary recrystallized grain structure becomes larger than 0.6 and the grain structure becomes inhomogeneous, the secondary recrystallization becomes unstable in Japanese Patent Publication (B2) No. 8-32929.

Furthermore, the inventors engaged in research on the control factor of secondary recrystallization, that is, the primary recrystallized structure, and inhibitor, and as a result discovered that {411} oriented grains in the primary recrystallized structure have an effect on the preferential growth of the {110}<001> secondary recrystallized grains and showed, in Japanese Patent Publication (A) No. 9-256051, that by adjusting the {111}/{411} ratio of the primary recrystallized texture after decarburization annealing to 3.0 or less, then performing the nitridation to strengthen the inhibitor, it is possible to produce grain-oriented electrical steel sheet high in magnetic flux density industrially stably and showed that as a method for control of the grain structure after primary recrystallization at this time, for example, there is the method of controlling the heating rate in the process of temperature elevation in the decarburizing annealing step to 12° C./s or more.

After this, it was learned that the above method of controlling the heating rate is very effective as a method of controlling the grain structure after primary recrystallization. The inventors proposed, in Japanese Patent Publication (A) No. 2002-60842, the method of rapidly heating the steel sheet in the process of temperature elevation in the decarburization annealing process up to a predetermined temperature in the range from the region of 600° C. or less to 750 to 900° C. by a heating rate of 40° C./s or more so as to control the I{111}/I{411} ratio in the grain structure after decarburization annealing to 3 or less and adjusting the amount of oxygen of the oxidized layer of the steel sheet in the subsequent annealing to 2.3 g/m$^2$ or less to stabilize the secondary recrystallization.

Here, I{111} and I{411} are the ratios of grains with {111} and {411} planes parallel to the sheet surface and show values of diffraction strengths measured at the sheet thickness 1/10 layer by X-ray diffraction measurement.

In the above method, rapid heating up to a predetermined temperature in the range of 750 to 900° C. by a heating rate of 40° C./s or more is necessary. Regarding the heating means for this, modified decarburization annealing facilities using radiant tubes utilizing conventional ordinary radiant heat etc., the method of utilizing lasers or other high energy heat sources, induction heating, electrical heating apparatuses, etc. may be mentioned, but among these heating methods, in particular induction heating is advantageous in the points that it has a high freedom of heating rate, enables heating without contact with the steel sheet, and is relatively easy to install in decarburization annealing furnaces.

In this regard, when using induction heating to heat electrical steel sheets, it is difficult to heat electrical steel sheet to a temperature of the Curie point or more, since the sheets are thin, when the temperature becomes close to the Curie point, the current penetration depth of the eddy current becomes deeper, the eddy current circling the front surface in the strip width direction cross-section is cancelled out at the front and rear, and the eddy current no longer flows.

The Curie point of grain-oriented electrical steel sheet is about 750° C., so even if using induction heating for heating to a temperature up to this, for heating to a temperature above this, it is necessary to use another means to take the place of the induction heating, for example, electrical heating.

However, using another heating means in combination loses the advantage in facilities of use of induction heating. Also, for example, with electrical heating, contact with the steel sheet becomes necessary. There was therefore the problem that the steel sheet was scratched.

For this reason, when the end of the rapid heating region is 750 to 900° C. as shown in Japanese Patent Publication (A) No. 2002-60842, there was the problem that it was not possible to sufficiently enjoy the advantages of induction heating.

DISCLOSURE OF THE INVENTION

Therefore, the present invention has as its object, when using low temperature slab heating for producing grain-oriented electrical steel sheet, to make the temperature region for control of the heating rate in the temperature elevation process of the decarburization annealing for improving the grain structure after primary recrystallization after decarburizing annealing a range able to be heated by just induction heating and thereby solve the above problem.

To solve the above problem, the method of production of grain-oriented electrical steel sheet of the present invention provides:

(1) A method of production of grain-oriented electrical steel sheet comprising heating a silicon steel material containing, by mass %, Si: 0.8 to 7%, C: 0.085% or less, acid soluble Al: 0.01 to 0.065%, and N: 0.012% or less at a temperature of 1280° C. or less, then hot rolling it, annealing the obtained hot rolled sheet, then cold rolling it once or cold rolling it several times with intermediate annealing to obtain steel sheet of the final sheet thickness, decarburization annealing this steel sheet, then coating an annealing separator, applying final annealing, and applying treatment to increase an amount of nitrogen of the steel sheet from the decarburization-annealing to the start of secondary recrystallization in the final annealing, characterized by performing the annealing of the hot rolled sheet by heating the sheet up to a predetermined temperature of 1000 to 1150° C. to cause recrystallization, then annealing it by a temperature of 850 to 1100° C. lower than that temperature to thereby control a lamellar spacing in the grain structure after annealing to 20 μm or more and by heating in the temperature elevation process in the decarburization annealing of the steel sheet by a rate of 40° C./s or more in the temperature range of a steel sheet temperature of 550° C. to 720° C.

Here, "lamellar structures", as shown in FIG. 1, refer to a layered structures split by the transformation phases or crystal grain boundaries and parallel to the rolling surface, while the "lamellar spacing" is the average spacing between these lamellar structures.

(2) A method of production of grain-oriented electrical steel sheet comprising heating a silicon steel material containing, by mass %, Si: 0.8 to 7%, C: 0.085% or less, acid soluble Al: 0.01 to 0.065%, and N: 0.012% or less at a temperature of 1280° C. or less, then hot rolling it, annealing the obtained hot rolled sheet, then cold rolling it once or cold rolling it several times with intermediate annealing to obtain steel sheet of the final sheet thickness, decarburization annealing this steel sheet, then coating an annealing separator, applying final annealing, and applying treatment to increase an amount of nitrogen of the steel sheet from the decarburization annealing to the start of secondary recrystallization of the final annealing characterized by, in the annealing process of the hot rolled sheet, decarburizing the steel sheet to 0.002 to 0.02 mass % of the amount of carbon before decarburization annealing to thereby control a lamellar spacing in the surface layer grain structure after annealing to 20 μm or more and by heating in the temperature elevation process in the decarburization annealing of the steel sheet of the final sheet thickness by a heating rate of 40° C./s or more in the temperature range of a steel sheet temperature of 550° C. to 720° C.

Here, the "surface layer" of the "surface layer grain structure" refers to the region from the outermost surface part to ⅕ the total sheet thickness, while the "lamellar spacing" is the average spacing of lamellar structures parallel to the rolling surface in this region.

Further, in the invention of the above (1) or (2), (3) the present invention is further characterized by heating in the temperature evaluation process in the decarburization annealing of the steel sheet by a heating rate of 50 to 250° C./s between a steel sheet temperature of 550° C. to 720° C.

(4) the present invention is further characterized by heating in the temperature elevation process in the decarburization annealing of the steel sheet by a heating rate of 75 to 125° C./s between a steel sheet temperature of 550° C. to 720° C.

(5) the present invention is further characterized by performing the heating of the steel sheet in the temperature range of a steel sheet temperature of 550° C. to 720° C. when decarburization annealing said steel sheet by induction heating.

(6) the present invention is further characterized by, making the temperature range for heating by said heating rate in the temperature elevation process in the decarburization annealing, to be from Ts (° C.) to 720° C., making it the following range from Ts (° C.) to 720° C. in accordance with the heating rate H (° C./s) from room temperature to 500° C.:

$H \leqq 15$: $Ts \leqq 550$ $15 < H$: $Ts \leqq 600$ (7) the present invention is further characterized by performing said decarburization annealing in a time interval so that the amount of oxygen of the steel sheet becomes 2.3 g/m$^2$ or less and the primary recrystallization grain size becomes 15 μm or more, at a temperature range of 770 to 900° C. under the conditions where the oxidation degree ($PH_2O/PH_2$) of the atmospheric gas is in a range of over 0.15 to 1.1.

(8) the present invention is further characterized by increasing the amount of nitrogen [N] of said steel sheet in accordance with an amount of acid soluble Al [Al] of the steel sheet so as to satisfy the formula $[N] \geqq 14/27[Al]$.

(9) the present invention is further characterized by increasing the amount of nitrogen [N] of said steel sheet in accordance with an amount of acid soluble Al [Al] of the steel sheet so as to satisfy the formula $[N] \leqq 2/3\ [Al]$

(10) the present invention is further characterized by, when coating said annealing separator, coating an annealing separator mainly comprised of alumina and performing the final annealing.

(11) the present invention is further characterized in that said silicon steel material further contains, by mass %, one or more of Mn: 1% or less, Cr: 0.3% or less, Cu: 0.4% or less, P: 0.5% or less, Sn: 0.3% or less, Sb: 0.3% or less, Ni: 1% or less, and S and Se in a total of 0.015% or less.

The present invention uses low temperature slab heating for the production of grain-oriented electrical steel sheet during which it anneals the hot rolled sheet in the above two temperature ranges or decarburizes the hot rolled sheet at the time of annealing in the above way to control the lamellar spacing and thereby rapidly heat the sheet in the temperature elevation process of the decarburizing annealing to improve the primary recrystallized grain structure after decarburizing annealing. At this time, the upper limit of the temperature for maintaining the heating rate high can be made a lower temperature range enabling heating by induction heating, so the heating can be performed more easily and grain-oriented electrical steel sheet superior in magnetic properties can be produced more easily.

For this reason, since the heating can be performed by induction heating, the degree of freedom of the heating rate is high, the heating is possible without contact with the steel sheet, installation in the decarburization annealing furnace is relatively easy, and other advantageous effects are obtained.

In the present invention, further, by adjusting the oxidation degree in the decarburization annealing or the amount of nitrogen of the steel sheet in the above way, even when raising the heating rate of the decarburization annealing, the secondary recrystallization can be performed more stably.

Further, in the present invention, by adding the above elements to the silicon steel material, it is possible to further improve the magnetic properties etc. in accordance with the added elements. By using an annealing separator mainly comprised of alumina at the time of final annealing, it is possible to produce mirror-surface grain-oriented electrical steel sheet.

BEST MODE FOR CARRYING OUT INVENTION

The inventors thought that when heating a silicon steel material containing, by mass %, Si: 0.8 to 7%, C: 0.085% or less, acid soluble Al: 0.01 to 0.065%, and N: 0.012% by a temperature of 1280° C. or less, then hot rolling it, annealing the obtained hot rolled sheet, then cold rolling it once or cold rolling it a plurality of times with intermediate annealing to obtain steel sheet of the final sheet thickness, decarburization annealing the steel sheet, then coating it with an annealing separator and final annealing it and nitriding the steel sheet from the decarburization annealing to the start of secondary recrystallization of the final annealing so as to produce grain-oriented electrical steel sheet, the lamellar spacing in the grain structure of the hot rolled sheet after annealing might have an effect on the grain structure after primary recrystallization and that even if lowering the temperature for suspending rapid heating at the time of decarburization annealing (even if suspending it before the temperature at which primary recrystallization occurs), the ratio of {411} grains in the primary recrystallized texture might be raised, and changed the annealing conditions of hot rolled sheet in various ways to investigate the relationship of the lamellar spacing in the grain structure after annealing of the hot rolled sheet with the magnetic flux density B8 of the steel sheet after secondary recrystallization and the effect of the heating rate at different temperatures in the temperature elevation process of the decarburization annealing on the magnetic flux density B8.

As a result, they obtained the discovery that, in the process of annealing the hot rolled sheet, when heating the sheet at a predetermined temperature to cause it to recrystallize, then further annealing it by a temperature lower than that temperature to control the lamellar spacing of the grain structure after annealing to 20 μm or more, the temperature range with the large change in structure in the temperature elevation process of the decarburization annealing process is 700 to 720° C. and that by making the heating rate in the temperature range of 550° C. to 720° C. including that temperature range 40° C./s or more, preferably 50 to 250° C./s, more preferably 75 to 125° C./s, it is possible to control the primary recrystallization so that the ratio of the I{111}/I{411} of the texture after decarburization annealing becomes a predetermined value or less and possible to stably promote a secondary recrystallized structure and thereby completed the present invention.

Here, the "lamellar spacing" is the average spacing of the layered structures parallel to the rolling surface called "lamellar structures".

Below, the experiment by which this discovery was obtained will be explained.

First, the inventors investigated the relationship between the annealing conditions of the hot rolled sheet and the magnetic flux density B8 of samples after final annealing.

Figure 1:
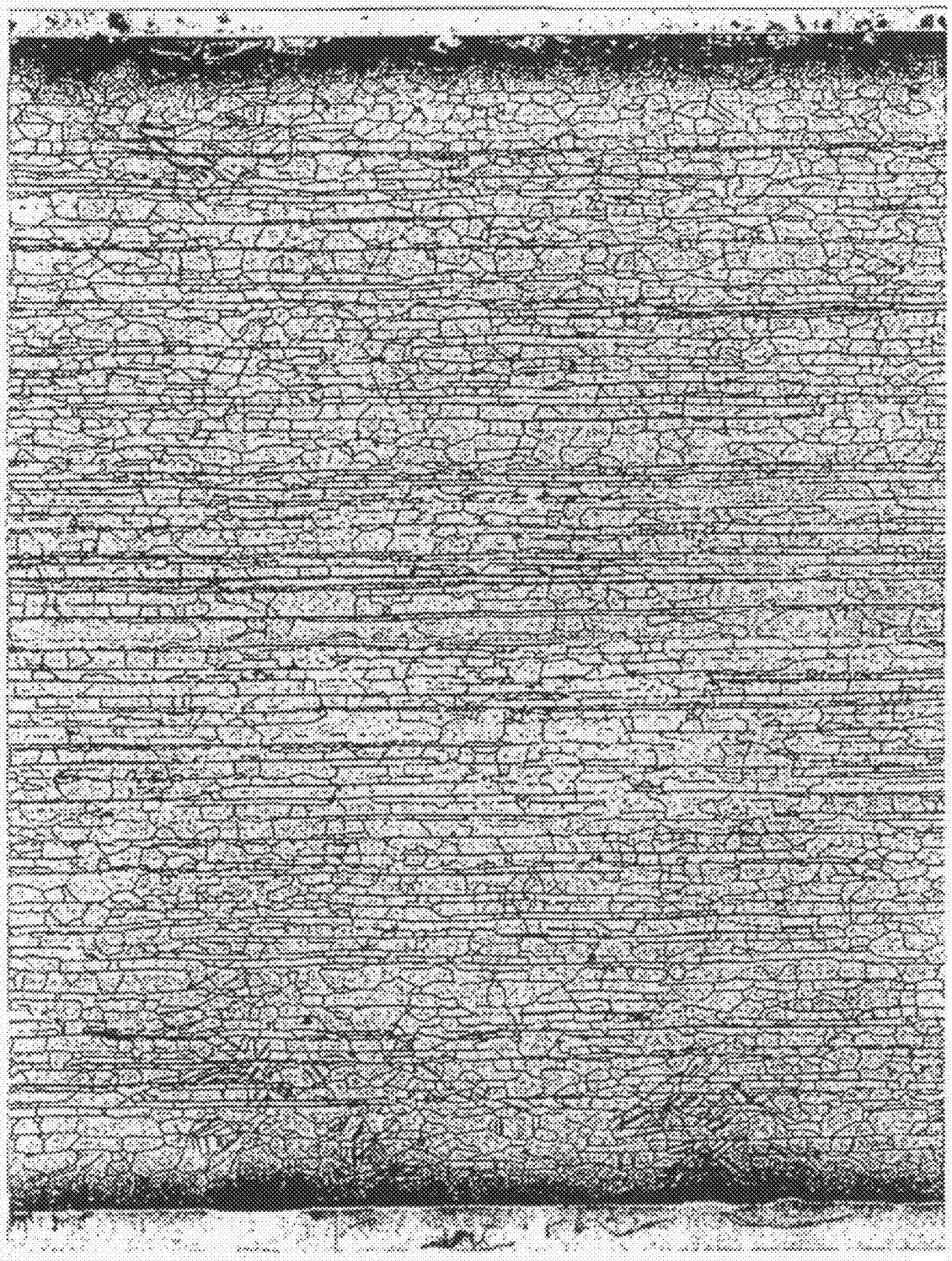
FIG. 1 is a view showing the lamellar structure in a grain structure before cold rolling at a cross-section parallel to the rolling direction (sheet thickness 2.3 mm).
Figure 2:
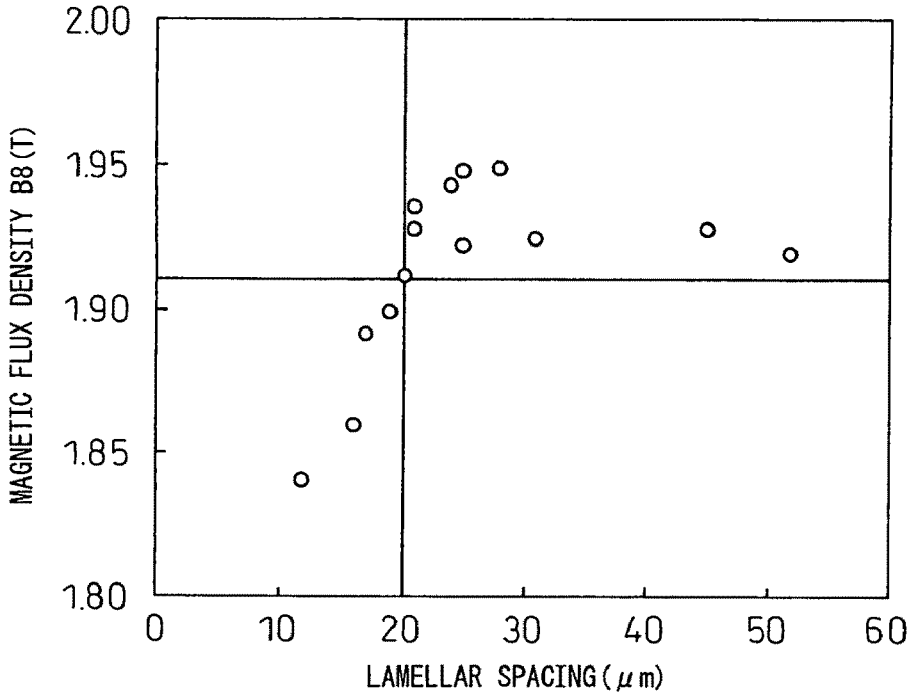
FIG. 2 is a view showing the relationship between the lamellar spacing of the grain structure before cold rolling and the magnetic flux density (B8) of a sample obtained by annealing the hot rolled sheet in two stages of temperature ranges.

FIG. 2 shows the relationship between the lamellar spacing of the grain structure in samples before cold rolling and the magnetic flux density B8 of samples after final annealing. The samples used here were obtained by heating a slab containing, by mass %, Si: 3.3%, C: 0.045 to 0.065%, acid soluble Al: 0.027%, N: 0.007%, Mn: 0.1%, and S: 0.008% and having a balance of Fe and unavoidable impurities by a temperature of 1150° C., then hot rolling it to a 2.3 mm thickness, then heating this to 1120° C. to cause it to recrystallize, then annealing the hot rolled sheet in two stages of annealing at a temperature of 800 to 1120° C., cold rolling the hot rolled sheet to a 0.22 mm thickness, then heating it by a heating rate of 15° C./s to 550° C., heating it by a heating rate of 40° C./s to the temperature range of 550 to 720° C., then further heating it by a heating rate of 15° C./s for decarburizing annealing at a temperature of 830° C., then annealing it in an ammonia-containing atmosphere to increase the nitrogen in the steel sheet for nitridation, then coating it with an annealing separator mainly comprised of MgO, then final annealing it. The lamellar spacing was adjusted by changing the amount of C and the second temperature in the two-stage hot rolled sheet annealing.

As clear from FIG. 2, it is learned that a high magnetic flux density of a B8 of 1.91 T or more is obtained at a lamellar spacing of 20 μm or more.

Further, the inventors analyzed the primary recrystallized texture of decarburization annealed sheets of samples giving a B8 of 1.91 T or more and as a result confirmed that in all samples, the value of I{111}/I{411} was 3 or less.

Figure 3:
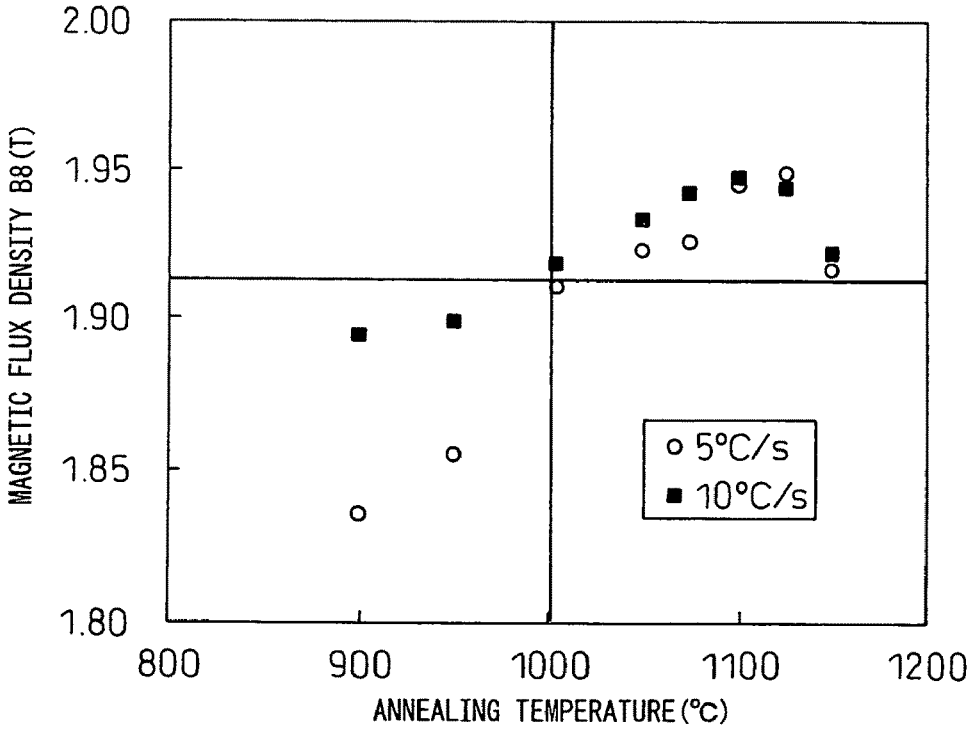
FIG. 3 is a view showing the relationship between a first annealing temperature and the magnetic flux density (B8) of a sample obtained by annealing the hot rolled sheet in two stages of temperature ranges.

Still further, FIG. 3 shows the relationship between the first heating temperature in the case of heating by two stages in the hot rolled sheet annealing and the magnetic flux density B8 of the samples after final annealing.

The samples used here were prepared in the same way as the case of FIG. 2 except for making the first temperature in the temperatures of the hot rolled sheet annealing 900° C. to 1150° C. and the second temperature 920° C. Note that the heating rate when heating to the first temperature was made 5° C./s and 10° C./s.

As clear from FIG. 3, it is learned that a high magnetic flux density of a B8 of 1.91 T or more is obtained at the first hot rolled sheet annealing temperature of 1000° C. to 1150° C.

Further, the inventors analyzed the primary recrystallized texture of decarburization annealed sheets of samples giving a B8 of 1.91 T or more and as a result confirmed that in all samples, the value of I{111}/I{411} was 3 or less.

Next, the inventors investigated the heating conditions at the time of decarburization annealing giving steel sheets of a high magnetic flux density (B8) under conditions of a lamellar spacing of the grain structure in the samples before cold rolling of 20 μm or more.

Cold rolled samples prepared in the same way as in the case of FIG. 2 except for making the C content 0.055%, making the first hot rolled sheet annealing temperature 1120° C., making the second hot rolled sheet annealing temperature 920° C., and making the lamellar spacing 25 μm were decarburization annealed while changing the heating rate of the temperature range of 550 to 720° C. at the time of decarburization annealing in various ways during the temperature elevation. Further, the magnetic flux densities B8 of the samples after final annealing were measured.

Figure 4:
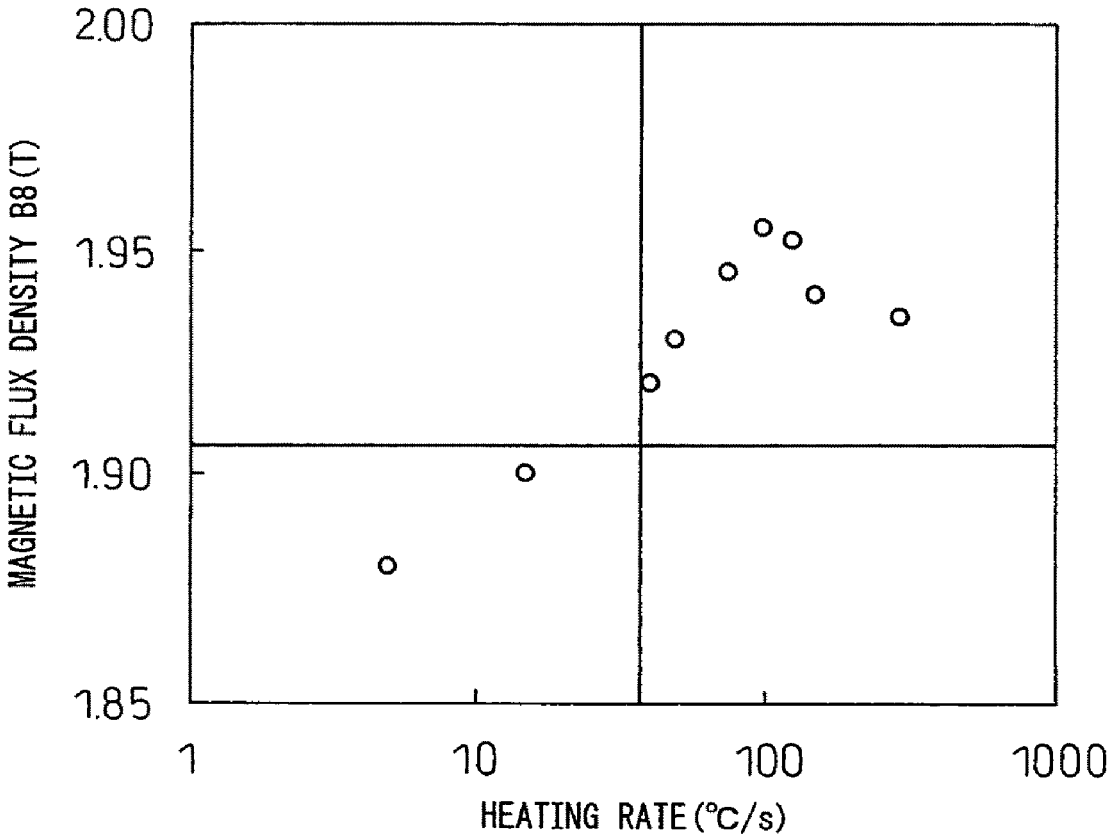
FIG. 4 is a view showing the relationship between the heating rate in a temperature range of 550 to 720° C. during temperature elevation in decarburization annealing and the magnetic flux density (B8) of a sample obtained by annealing the hot rolled sheet in two stages of temperature ranges.

From FIG. 4, it is learned that if controlling the heating rate at the temperatures in the temperature range of 550° C. to 720° C. in the temperature elevation process of the decarburization annealing to 40° C./s or more, electrical steel sheet having a magnetic flux density (B8) of 1.91 T or more is obtained, while if controlling the heating rate to a range of 50 to 250° C./s, more preferably 75 to 125° C./s, electrical steel sheet with a further higher magnetic flux density of a B8 of 1.92 T or more is obtained.

Therefore, it is learned that, in the process of annealing the hot rolled sheet, by heating to a predetermined temperature of 1000 to 1150° C. to cause recrystallization, then annealing at a lower temperature than this of 850 to 1100° C. to control the lamellar spacing in the grain structure after annealing to 20 μm or more, even if making the temperature range for rapid heating in the temperature elevation process of the decarburization annealing process a steel sheet temperature of a range of 550° C. to 720° C., it is possible to raise the ratio of the grains of the {411} orientation, possible, as shown in Japanese Patent Publication (B2) No. 8-32929, to make the ratio of I{111}/I{411} 3 or less, and possible to stably produce grain-oriented electrical steel sheet with a high magnetic flux density.

In the above way, since it was confirmed that control of the lamellar spacing to 20 μm or more in the grain structure after hot rolled sheet annealing is effective, the inventors also studied other means for controlling the lamellar spacing to 20 μm or more.

As a result, the inventors discovered from experiments similar to the experiments for finding FIGS. 2 and 4 that by decarburization annealing the amount of carbon of the steel sheet before decarburizing in the annealing process of the hot rolled sheet to 0.002 to 0.02 mass %, it is possible to make the lamellar spacing 20 μm or more in the surface layer grain structure after annealing and, even if doing so, by similarly making the heating rate in the temperature range of 550° C. to 720° C. in the temperature elevation process of the decarburization annealing after cold rolling 40° C./s or more, it is possible to control the primary recrystallization so that the ratio of the I{111}/I{411} of the texture after decarburization annealing becomes a predetermined value or less and possible to stably promote a secondary recrystallized structure.

Here, "lamellar spacing" is the average spacing of the layered structures parallel to the rolling surface called "lamellar structures". Further, the "surface layer" of the surface layer grain structure means the region from the surface most part to ⅕ of the sheet total thickness.

Figure 5:
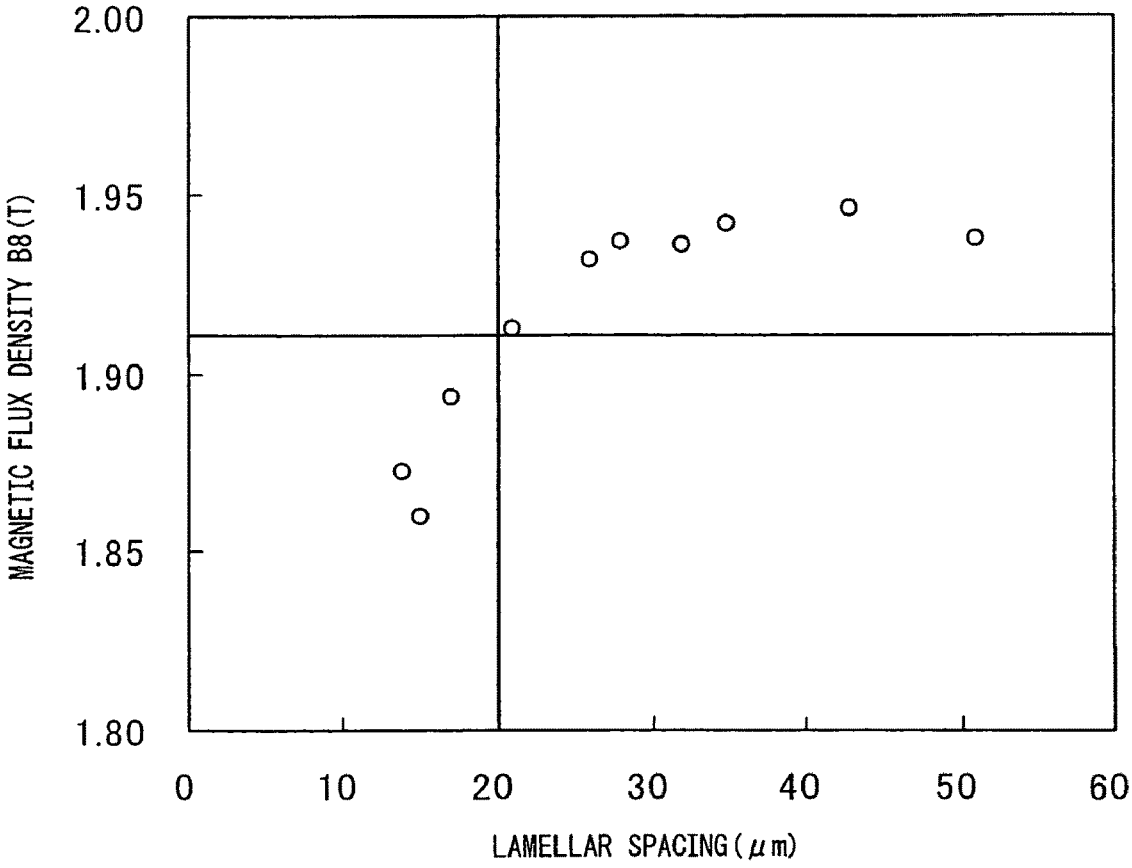
FIG. 5 is a view showing the relationship between the lamellar spacing of the surface layer grain structure before cold rolling and the magnetic flux density (B8) of a sample decarburized at the time of annealing the hot rolled sheet.

FIG. 5 shows the relationship between the lamellar spacing before cold rolling and the magnetic flux density B8 of the samples after final annealing in which lamellar spacing of the surface layer grain structure after annealing were changed by decarburization in the processing of hot rolled sheet annealing. Note that lamellar spacing of the surface layer was adjusted by changing the steam partial pressure of the atmospheric gas in the annealing of the hot rolled sheet performed at 1100° C. so that the difference in amounts of carbon before and after decarburization became a range of 0.002 to 0.02 mass %.

As will be clear from FIG. 5, it is learned that even when decarburizing the hot rolled sheet in the process of annealing it so as to make the lamellar spacing of the surface layer 20 μm or more, a high magnetic flux density B8 of 1.91 T or more is obtained.

Figure 6:
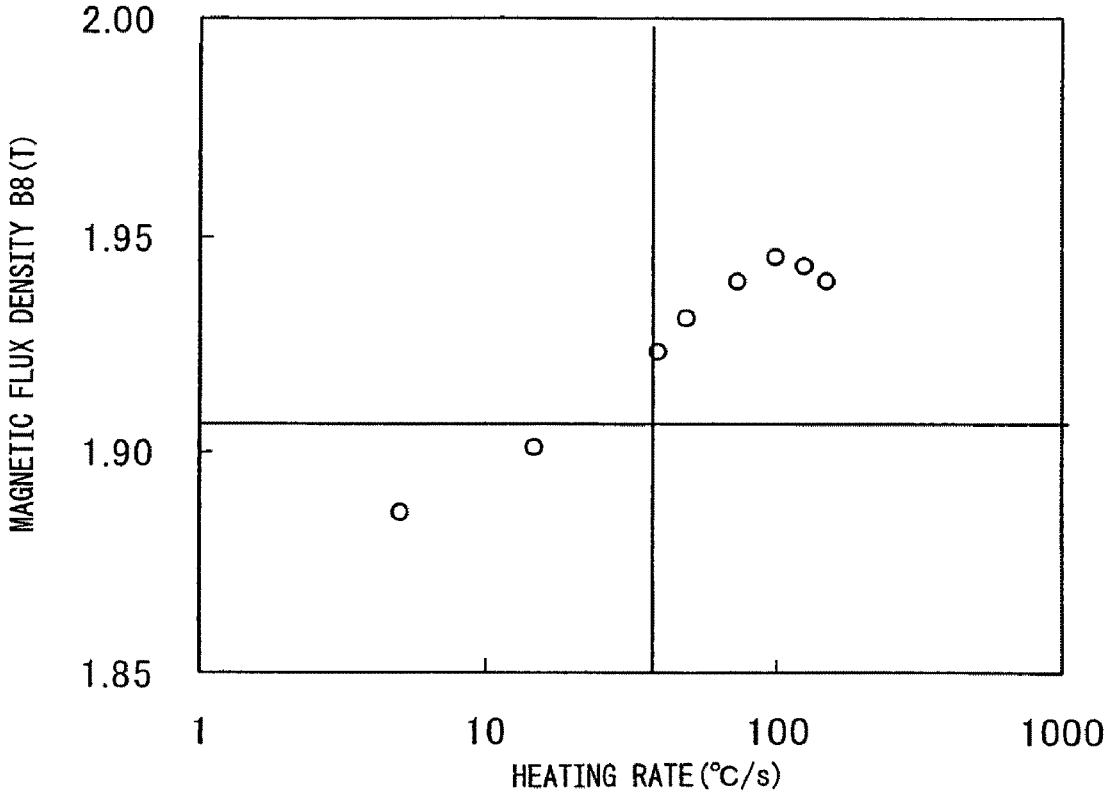
FIG. 6 is a view showing the relationship between the heating rate of the temperature range of 550 to 720° C. during temperature elevation in decarburization annealing and the magnetic flux density (B8) of a sample decarburized at the time of annealing the hot rolled sheet.

Further, FIG. 6 shows the relationship between the heating rate of the temperature range of 550 to 720° C. during temperature elevation at the time of decarburization annealing and the magnetic flux density B8 of samples after final annealing which were prepared in the same way by adjusting the oxidation degree of the atmospheric gas in the hot rolled sheet annealing to make the lamellar spacing of the surface layer grain structure 25 μm.

From FIG. 6, it is learned that even when controlling the lamellar spacing by decarburization in the process of annealing hot rolled sheet, if the heating rate in the temperature range of 550° C. to 720° C. in the temperature elevation process of the decarburization annealing is 40° C./s or more, electrical steel sheet with a high magnetic flux density is obtained.

The reason why the lamellar spacing in the grain structure after hot rolled sheet annealing causes the {411}, {111} texture to change is still not clear, but currently is believed to be as follows. It is known that there are preferential nucleation sites and they are different due to the orientation of recrystallization.

Supposing that in the cold rolling process, {411} nuclei are formed inside the lamellar structure and {111} nuclei are formed near the lamellar parts at {111}, it is possible to explain the phenomenon of the change of the ratio of crystal orientation of {411} and {111} after primary recrystallization by control of the lamellar spacing of the crystal structure before cold rolling.

The present invention created based on the above discoveries will be successively explained below.

First, the reasons for limitation of the ingredients of the silicon steel material used in the present invention will be explained.

The present invention uses as a material a silicon steel slab for grain-oriented electrical steel sheet containing at least, by mass %, Si: 0.8 to 7%, C: 0.085% or less, acid soluble Al: 0.01 to 0.065%, and N: 0.012% or less and having a balance of Fe and unavoidable impurities as a basic composition of ingredients and if necessary containing other ingredients. The reasons for limitation of the ranges of content of the ingredients are as follows.

If the amount of Si is increased, the electrical resistance rises and the core loss characteristic is improved. However, if added over 7%, cold rolling becomes extremely difficult and the sheet ends up cracking at the time of rolling. The value more suited for industrial production is 4.8% or less. Further, if smaller than 0.8%, at the time of final annealing, γ transformation occurs and the crystal orientation of the steel sheet ends up being impaired.

C is an element effective in controlling the primary recrystallized structure, but has a detrimental effect on the magnetic properties, so decarburization is necessary before final annealing. If C is greater than 0.085%, the decarburization annealing time becomes longer and the productivity in industrial production is impaired.

The acid soluble Al is an essential element which bonds with N in the present invention to form (Al,Si)N functioning as an inhibitor. The 0.01 to 0.065% where the secondary recrystallization stabilizes is made the range of limitation.

N, if over 0.012%, causes holes called "blisters" in the steel sheet at the time of cold rolling, so is made not to exceed 0.012%.

In the present invention, the slab material may include, in addition to the above ingredients, in accordance with need at least one type of element of Mn, Cr, Cu, P, Sn, Sb, Ni, S, and Se in amounts, by mass %, of Mn of 1% or less, Cr of 0.3% or less, Cu of 0.4% or less, P of 0.5% or less, Sn of 0.3% or less, Sb of 0.3% or less, Ni of 1% or less, and a total of S and Se of 0.015% or less. That is, Mn has the effect of raising the specific resistivity and reducing the core loss. Further, for the purpose of preventing cracking in hot rolling, it is preferably added in an amount of $Mn/(S+Se) \geqq 4$ in relation to the total amount of S and Se. However, if the amount of addition exceeds 1%, the magnetic flux density of the product ends up falling.

Cr is an element effective for improving the oxidized layer in decarburizing annealing and forming a glass film and is added in a range of 0.3% or less.

Cu is an element effective for raising the specific resistivity and reducing the core loss. If the amount of addition is over 0.4%, the effect of reduction of the core loss becomes saturated. This becomes a cause of the surface defect of "bald spots" at the time of hot rolling.

P is an element effective for raising the specific resistivity and reducing the core loss. If the amount of addition is over 0.5%, a problem arises in the rollability.

Sn and Sb are well known grain boundary segregating elements. The present invention contains Al, so depending on the conditions of the final annealing, sometimes the moisture released from the annealing separator causes the Al to be oxidized and the inhibitor strength to fluctuate at the coil position and the magnetic properties fluctuates by the coil position. As one countermeasure, there is the method of preventing oxidation by adding these grain boundary segregating elements. For this reason, these can be added in ranges of 0.30% or less. On the other hand, if over 0.30%, the steel becomes difficult to oxidize at the time of decarburizing annealing, formation of a glass film becomes insufficient, and the decarburizing annealing ability is remarkably impaired.

Ni is an element effective for raising the specific resistivity and reducing the core loss. Further, it is an element effective when controlling the metal structure of the hot rolled sheet to improve the magnetic properties. However, if the amount of addition exceeds 1%, the secondary recrystallization becomes unstable.

In addition, S and Se have a detrimental effect on the magnetic properties, so the total amount is preferably made 0.015% or less.

Next, the production conditions of the present invention will be explained.

The silicon steel slab having the above composition of ingredients is obtained by producing the steel by a converter, electric furnace, etc., vacuum degassing the molten steel in accordance with need, then continuously casting or making ingots, then cogging. After this, the slab is heated before hot rolling. In the present invention, the slab heating temperature is made 1280° C. or less to avoid the above problems of high temperature slab heating.

The silicon steel slab is usually cast to a thickness of a range of 150 to 350 mm, preferably a thickness of 220 to 280 mm, but it may also be a so-called thin slab of a range of 30 to 70 mm. In the case of a thin slab, there is the advantage that it is not necessary to roughly rolled process the steel to an intermediate thickness at the time of producing hot rolled sheet.

The slab heated by the above temperature is next hot rolled and made a hot rolled sheet of the required sheet thickness.

In the present invention, (a) this hot rolled sheet is heated to a predetermined temperature of 1000 to 1150° C. to cause recrystallization, then is annealed at a temperature lower than this of 850 to 1100° C. for the necessary time. Alternatively, (b) it is decarburized in the process of annealing this hot rolled sheet so that the difference in amount of carbon of the steel sheet before and after decarburization becomes 0.002 to 0.02 mass %.

By doing this, the lamellar spacing of the grain structure of the steel sheet after annealing (or steel sheet surface layer) is controlled to 20 μm or more.

When annealing as in (a), the first annealing temperature range is made 1000 to 1150° C. because a steel sheet of a magnetic flux density of B8 of 1.91 T or more is obtained when recrystallized in this range as shown in FIG. 3, while the second annealing temperature range is made 850 to 1100° C. lower than the first temperature because, as shown in FIG. 2, this is necessary for making the lamellar spacing 20 μm or more.

As more preferable conditions, the first annealing temperature is 1050 to 1125° C. and the second annealing temperature is 850° C. to 950° C.

The first annealing, from the viewpoint of promoting recrystallization of the hot rolled sheet, is performed at 5° C./s or more, preferably 10° C./s or more. At a high temperature of 1100° C. or more, the annealing should be performed for 0 second or more, while at a low temperature of 1000° C. or so, it is performed for 30 seconds or more. Further, the second annealing time, from the viewpoint of controlling the lamellar structure, should be 20 seconds or more. After the second annealing, from the viewpoint of maintaining the lamellar structure, the sheet should be cooled by a cooling rate of an average 5° C./s or more, preferably 15° C./s or more.

Note that annealing a hot rolled sheet in two stages is described in Japanese Patent Publication (A) No. 2005-226111 as well, but the method of production of grain-oriented electrical steel sheet described in this publication is a combination of the method of causing the inhibitor to finely precipitate by the hot rolling process etc. explained in the section on the background art and the method of forming an inhibitor by nitridation after decarburization annealing. The object of this annealing is the adjustment of the state of the inhibitor. That is not related at all to the fact that, like in the present invention, when using the latter method to produce grain-oriented electrical steel sheet, annealing the hot rolled sheet in two stages so as to control the lamellar spacing in the grain structure after annealing enables the ratio of grains of an orientation enabling easy secondary recrystallization after primary recrystallization to be increased even if making the range of rapid heating in the temperature elevation process of decarburizing annealing a lower temperature range.

Further, when decarburizing the sheet in the process of annealing the hot rolled sheet as in (b), as the treatment method, the method of introducing steam into the atmospheric gas to adjust the oxidation degree and, further, the method of coating a decarburization accelerator (for example, $K_2CO_3$ or $Na_2CO_3$) on the surface of the steel sheet or another known method may be used.

The amount of decarburization at that time (difference of amounts of carbon of steel sheet before and after decarburization) is made a range of 0.002 to 0.02 mass %, preferably a range of 0.003 to 0.008 mass % to control the lamellar spacing of the surface layer. If the amount of decarburization is less than 0.002 mass %, there is no effect on the lamellar spacing of the surface, while if 0.02 mass % or more, there is a detrimental effect on the texture of the surface part.

The hot rolled sheet controlled to a lamellar spacing of 20 μm or more in this way is then cold rolled once or two or more times with intermediate annealing to obtain the final sheet thickness. The number of times of cold rolling is suitably selected considering the level of characteristics and cost of the product desired. At the time of cold rolling, making the final cold rolling rate 80% or more is necessary for promoting the {411} and {111} or other primary recrystallization orientation.

The cold rolled steel sheet is decarburization annealed in a moist atmosphere so as to remove the C contained in the steel. At that time, by making the ratio of I{111}/I{411} in the grain structure after decarburization annealing 3 or less and then increasing the nitrogen before causing the secondary recrystallization, it is possible to stably produce a product with a high magnetic flux density.

As the method for controlling the primary recrystallization after this decarburization annealing, the heating rate in the temperature elevation process of the decarburizing annealing step is adjusted. The present invention is characterized by the point of rapid heating between a steel sheet temperature of at least 550° C. to 720° C. by a heating rate of 40° C./s or more, preferably 50 to 250° C./s, more preferably 75 to 125° C./s.

The heating rate has a large effect on the primary recrystallized texture I{111}/I{411}. In primary recrystallization, the ease of recrystallization differs depending on the crystal orientation, so to make I{111}/I{411} 3 or less, control to a heating rate enabling easy recrystallization of the {411} oriented grains is necessary. {411} oriented grains easily recrystallize the most at a speed near 100° C./s, so to make the I{111}/I{411} 3 or less and stably produce a product with a magnetic flux density B8 of 1.91 T or more, the heating rate is made 40° C./s or more, preferably 50 to 250° C./s, more preferably 75 to 125° C./s.

The temperature range at which heating by this heating rate is necessary is basically the temperature range from 550° C. to 720° C. Of course, it is also possible to start the rapid heating by the above heating rate range from a temperature under 550° C. The lower limit temperature of the temperature range for maintaining this heating rate at a high heating rate is affected by the heating cycle in the low temperature region. For this reason, when making the temperature range where rapid heating is required the start temperature Ts (° C.) to 720° C., the range should be made the following Ts (° C.) to 720° C. in accordance with the heating rate H (° C./s) from room temperature to 500° C.

$H \leqq 15$: $Ts \leqq 550$ $15 < H$: $Ts \leqq 600$

In the case where the heating rate in the low temperature region is the standard heating rate of 15° C./s, it is necessary to rapidly heat the sheet in the range of 550° C. to 720° C. by a heating rate of 40° C./s or more. When the heating rate in the low temperature region is slower than 15° C./s, it is necessary to rapidly heat the sheet in the range of a temperature below 550° C. to 720° C. by a heating rate of 40° C./s or more. On the other hand, when the low temperature region heating rate is faster than 15° C./s, it is sufficient to rapidly heat the sheet in the range from a temperature higher than 550° C. and a temperature lower than 600° C. to 720° C. by a heating rate of 40° C./s or more. For example, when heating from room temperature by 50° C./s, the rate of temperature rise in the range from 600° C. to 720° C. should be 40° C./s or more.

The method of controlling the heating rate of the above decarburization annealing is not particularly limited, but in the present invention the upper limit of the temperature range of the rapid heating is 720° C., so it is possible to effectively utilize induction heating.

Further, to stably realize the effects of adjustment of the heating rate, as shown in Japanese Patent Publication (A) No. 2002-60842, it is effective to make the oxidation degree ($PH_2O/PH_2$) of the atmospheric gas in the temperature range of 770 to 900° C. after heating more than 0.15 to 1.1 and make the amount of oxygen of the steel sheet 2.3 g/m$^2$ or less. With an oxidation degree of the atmospheric gas less than 0.15, the adhesion of the glass film formed on the surface of the steel sheet becomes poor, while if over 1.1, defects occur in the glass film. Further, by making the amount of oxygen of the steel sheet 2.3 g/m$^2$ or less, it is possible to suppress the decomposition of the (Al,Si)N inhibitor and produce products of grain-oriented electrical steel sheet having a high magnetic flux density.

Further, in the decarburization annealing, by making the amount of oxygen of the steel sheet 2.3 g/m$^2$ or less and simultaneously, as shown in Japanese Patent Publication (B2) No. 8-32929, making the primary recrystallization grain size 15 μm or more, the secondary recrystallization can be more stably realized and more superior grain-oriented electrical steel sheet can be produced.

As the nitridation for increasing the nitrogen, there are the method of performing annealing in an atmosphere containing ammonia or another gas with a nitridation function after the decarburization annealing, the method of adding MnN or another-powder with a nitridation function to the annealing separator to perform the nitridation during the final annealing, etc.

When raising the heating rate of the decarburization annealing, to perform the secondary recrystallization more stably, it is preferable to adjust the ratio of composition of (Al,Si)N. Further, as the amount of nitrogen after the nitridation, the ratio of the amount of nitrogen [N] to the amount of Al [Al], that is, [N]/[Al], becomes a mass ratio of 14/27 or more, preferably 2/3 or more.

After this, the sheet is coated with an annealing separator mainly comprised of magnesia or alumina, then final annealed to make the {110}<001> oriented grains grow preferentially by secondary recrystallization.

When using an annealing separator having alumina as its main ingredient, as shown in Japanese Patent Publication (A) No. 2003-268450, an electrical steel sheet with a smoothed (mirror) surface is obtained after final annealing.

As explained above, in the present invention, when producing grain-oriented electrical steel sheet by heating silicon steel to a temperature of 1280° C. or less, then hot rolling it, annealing the hot rolled sheet, then cold rolling it once or cold rolling it a plurality of times with intermediate annealing to obtain the final sheet thickness, decarburizing annealing it, then coating an annealing separator and final annealing it and nitriding the steel sheet from the decarburization annealing to the start of secondary recrystallization of the final annealing, by (a) annealing the hot rolled sheet by heating it to a predetermined temperature of 1000 to 1150° C. to cause recrystallization, then annealing by a temperature lower than that of 850 to 1100° C. or by (b) decarburizing the hot rolled sheet in annealing so that the difference in amounts of carbon of the steel sheet before and after hot rolled sheet annealing becomes 0.002 to 0.02 mass % to thereby control the lamellar space to 20 μm or more in the grain structure of the steel sheet after hot rolled sheet annealing (or surface layer grain structure) and by heating the cold rolled steel sheet in the temperature elevation process at the time of decarburization annealing between a steel sheet temperature of 550° C. to 720° C. by a heating rate of 40° C./s or more, preferably 50 to 250° C./s, more preferably 75 to 125° C./s, then performing the decarburization annealing in the temperature range of 770 to 900° C. under conditions of an oxidation degree of the atmospheric gas ($PH_2O/PH_2$) in the range of over 0.15 to 1.1 with a time by which the amount of oxygen of the steel sheet becomes 2.3 $g/m^2$ or less and the primary recrystallization grain size becomes 15 μm or more, it is possible to produce grain-oriented electrical steel sheet with a high magnetic flux density and, further, by using an annealing separator mainly comprised of alumina at the time of final annealing, it is possible to produce a mirror surface grain-oriented electrical steel sheet with a high magnetic flux density.

Below, examples of the present invention will be explained, but the conditions employed in the examples are examples of conditions for confirming the workability and advantageous effects of the present invention. The present invention is not limited to this example. The present invention may employ various conditions insofar as not departing from the present invention and achieving the object of the present invention.

EXAMPLES

Example 1

A silicon steel slab containing, by mass %, Si: 3.3%, C: 0.06%, acid soluble Al: 0.028%, and N: 0.008% and having a balance of Fe and unavoidable impurities was heated at a temperature of 1150° C., then hot rolled to a 2.3 mm thickness, then samples (A) were annealed by a single stage of 1120° C. and samples (B) were annealed by two stages of 1120° C.+920° C. These samples were cold rolled to a 0.22 mm thickness, then heated by heating rates of (1) 15° C./s, (2) 40° C./s, (3) 100° C./s, and (4) 300° C./s to 720° C., then heated by 10° C./s to a temperature of 830° C. for decarburization annealing, then annealed in an ammonia-containing atmosphere to increase the nitrogen in the steel sheet to 0.02%, then coated by an annealing separator mainly comprised of MgO, then final annealed.

The magnetic properties after final annealing of the obtained samples are shown in Table 1. Note that the notations of the samples show the combination of the annealing method and heating rate.

TABLE 1

| Sample | Lamellar spacing (μm) | Magnetic flux density B8 (T) | Remarks |
|---|---|---|---|
| (A-1) | 16 | 1.873 | Comp. ex. |
| (A-2) | 16 | 1.867 | Comp. ex. |
| (A-3) | 16 | 1.816 | Comp. ex. |
| (A-4) | 16 | 1.785 | Comp. ex. |
| (B-1) | 26 | 1.89 | Comp. ex. |
| (B-2) | 26 | 1.921 | Inv. ex. |
| (B-3) | 26 | 1.942 | Inv. ex. |
| (B-4) | 26 | 1.934 | Inv. ex. |

Example 2

A silicon steel slab containing, by mass %, Si: 3.3%, C: 0.055%, acid soluble Al: 0.027%, N: 0.008%, Mn: 0.1%, S: 0.007%, Cr: 0.1%, Sn: 0.05%, P: 0.03%, and Cu: 0.2% and having a balance of Fe and unavoidable impurities was heated to a temperature of 1150° C., then hot rolled to a 2.3 mm thickness, then samples (A) were annealed by one stage at 1100° C. and samples (B) were annealed by two stages at 1100° C.+900° C. These samples were cold rolled to 0.22 mm thicknesses, then heated by a heating rate of 40° C./s to 550° C. and further heated by heating rates of (1) 15° C./s, (2) 40° C./s, and (3) 100° C./s to 550 to 720° C., then further heated by a heating rate of 15° C./s and decarburization annealed at a temperature of 840° C., then annealed in an ammonia-containing atmosphere to increase the nitrogen in the steel sheet to 0.02%, then coated with an annealing separator mainly comprised of MgO, then final annealed.

The magnetic properties of the obtained samples after final annealing are shown in Table 2.

TABLE 2

| Sample | Lamellar spacing (μm) | Magnetic flux density B8 (T) | Remarks |
|---|---|---|---|
| (A-1) | 18 | 1.88 | Comp. ex. |
| (A-2) | 18 | 1.874 | Comp. ex. |
| (A-3) | 18 | 1.866 | Comp. ex. |
| (B-1) | 25 | 1.895 | Comp. ex. |
| (B-2) | 25 | 1.933 | Inv. ex. |
| (B-3) | 25 | 1.952 | Inv. ex. |

Example 3

A silicon steel slab containing, by mass %, Si: 3.3%, C: 0.055%, acid soluble Al: 0.027%, N: 0.008%, Mn: 0.1%, S: 0.007%, Cr: 0.1%, Sn: 0.06%, P: 0.03%, and Ni: 0.2% and having a balance of Fe and unavoidable impurities was heated to a temperature of 1150° C., then hot rolled to a 2.3 mm thickness, then samples (A) were annealed by a single stage of 1100° C. and samples (B) were annealed by two stages of 1100° C.+900° C. These sample were cold rolled to a 0.22 mm thickness, then heated by a heating rate of (1) 15° C./s, (2) 40° C./s, (3) 100° C./s, and (4) 200° C./s to 720° C., then heated by a heating rate of 10° C./s for decarburization annealing to a temperature of 840° C., then annealed in an ammonia-containing atmosphere to increase the nitrogen in the steel sheet to 0.02%, then coated by an annealing separator mainly comprised of MgO, then final annealed.

The magnetic properties after final annealing of the obtained samples are shown in Table 3.

TABLE 3

| Sample | Lamellar spacing (μm) | Magnetic flux density B8 (T) | Remarks |
|---|---|---|---|
| (A-1) | 15 | 1.854 | Comp. ex. |
| (A-2) | 15 | 1.861 | Comp. ex. |
| (A-3) | 15 | 1.852 | Comp. ex. |
| (A-4) | 15 | 1.838 | Comp. ex. |
| (B-1) | 27 | 1.905 | Comp. ex. |
| (B-2) | 27 | 1.923 | Inv. ex. |
| (B-3) | 27 | 1.942 | Inv. ex. |
| (B-4) | 27 | 1.933 | Inv. ex. |

Example 4

A silicon steel slab containing, by mass %, Si: 3.3%, C: 0.055%, acid soluble Al: 0.028%, N: 0.008%, Mn: 0.1%, Se: 0.007%, Cr: 0.1%, P: 0.03%, and Sn: 0.05% and having a balance of Fe and unavoidable impurities was heated to a temperature of 1150° C., then hot rolled to a 2.3 mm thickness, then samples (A) were annealed by a single stage of 1120° C. and samples (B) were annealed by two stages of 1120° C.+900° C. These samples were cold rolled to a 0.22 mm thickness, then heated by a heating rate of 15° C./s to 550° C., then further heated by a heating rate of (1) 15° C./s, (2) 40° C./s, and (3) 100° C./s to 550 to 720° C., then further heated by a heating rate of 10° C./s for decarburization annealing at a temperature of 830° C., then annealed in an ammonia-containing atmosphere to increase the nitrogen in the steel sheet to 0.02, then coated by an annealing separator mainly comprised of MgO, then final annealed.

The magnetic properties after final annealing of the obtained samples are shown in Table 4.

TABLE 4

| Sample | Lamellar spacing (μm) | Magnetic flux density B8 (T) | Remarks |
|---|---|---|---|
| (A-1) | 18 | 1.881 | Comp. ex. |
| (A-2) | 18 | 1.891 | Comp. ex. |
| (A-3) | 18 | 1.876 | Comp. ex. |
| (B-1) | 28 | 1.902 | Comp. ex. |
| (B-2) | 28 | 1.93 | Inv. ex. |
| (B-3) | 28 | 1.954 | Inv. ex. |

Example 5

A silicon steel slab containing, by mass %, Si: 3.3%, C: 0.06%, acid soluble Al: 0.028%, N: 0.008%, Mn: 0.1%, S: 0.008%, Cr: 0.1%, and P: 0.03% and having a balance of Fe and unavoidable impurities was heated to a temperature of 1150° C., then hot rolled to a 2.3 mm thickness, then annealed by two stages of 1120° C.+920° C. Samples were cold rolled to a 0.22 mm thickness, then heated by a heating rate of 100° C./s to 720° C., then heated by 10° C./s to a temperature of 830° C. for decarburization annealing, then annealed in an ammonia-containing atmosphere to increase the nitrogen in the steel sheet to 0.008 to 0.025%, then coated by an annealing separator mainly comprised of MgO, then final annealed.

The magnetic properties after final annealing of the obtained samples with different amounts of nitrogen are shown in Table 5.

TABLE 5

| Sample | Lamellar spacing (μm) | Nitrogen amount (%) | N/Al | Magnetic flux density B8 (T) | Remarks |
|---|---|---|---|---|---|
| (A) | 26 | 0.008 | 0.29 | 1.581 | Comp. ex. |
| (B) | 26 | 0.012 | 0.43 | 1.782 | Comp. ex. |
| (C) | 26 | 0.017 | 0.61 | 1.921 | Inv. ex. |
| (D) | 26 | 0.021 | 0.75 | 1.943 | Inv. ex. |
| (E) | 26 | 0.025 | 0.89 | 1.954 | Inv. ex. |

Example 6

A slab containing, by mass %, Si: 3.3%, C: 0.06%, acid soluble Al: 0.028%, and N: 0.008% and having a balance of Fe and unavoidable impurities was heated to a temperature of 1150° C., then hot rolled to a 2.3 mm thickness, then samples (A) were heated by a single stage of 1120° C. and samples (B) were heated by two stages of 1120° C.+920° C. These samples were cold rolled to a 0.22 mm thickness, then heated by a heating rate of (1) 15° C./s, (2) 40° C./s, (3) 100° C./s, and (4) 300° C./s to 720° C., then heated by 10° C./s to a temperature of 830° C. for decarburization annealing, then annealed in an ammonia-containing atmosphere to increase the nitrogen in the steel sheet to 0.024%, then coated with an annealing separator mainly comprised of MgO, then final annealed.

The magnetic properties after final annealing of samples are shown in Table 6. When both the hot rolled sheet annealing and decarburization annealing satisfy the conditions of the present invention, a high magnetic flux density is obtained.

TABLE 6

| Sample | Lamellar spacing (μm) | Magnetic flux density B8 (T) | Remarks |
|---|---|---|---|
| (A-1) | 16 | 1.885 | Comp. ex. |
| (A-2) | 16 | 1.893 | Comp. ex. |
| (A-3) | 16 | 1.898 | Comp. ex. |
| (A-4) | 16 | 1.883 | Comp. ex. |
| (B-1) | 26 | 1.911 | Comp. ex. |
| (B-2) | 26 | 1.931 | Inv. ex. |
| (B-3) | 26 | 1.957 | Inv. ex. |
| (B-4) | 26 | 1.933 | Inv. ex. |

Example 7

A slab containing, by mass %, Si: 3.3%, C: 0.06%, acid soluble Al: 0.028%, and N: 0.008% and having a balance of Fe and unavoidable impurities was heated to a temperature of 1150° C., then was hot rolled to a 2.3 mm thickness, then was annealed at a temperature of 1100° C. At that time, steam was blown into the atmospheric gas (mixed gas of nitrogen and hydrogen) to decarburize the surface and change the lamellar spacing of the surface layer. Samples were cold rolled to a 0.22 mm thickness, then heated by a heating rate of 100° C./s to 720° C., then heated by 10° C./s to a temperature of 830° C. for decarburization annealing, then annealed in an ammonia-containing atmosphere to increase the nitrogen in the steel sheet to 0.02%, then coated with an annealing separator mainly comprised of MgO, then final annealed.

The magnetic properties after final annealing of the obtained samples with different lamellar spacings of the surface layer are shown in Table 7.

TABLE 7

| Sample | Lamellar spacing (μm) | Magnetic flux density B8 (T) | Remarks |
|---|---|---|---|
| (A) | 14 | 1.873 | Comp. ex. |
| (B) | 26 | 1.917 | Inv. ex. |
| (C) | 29 | 1.933 | Inv. ex. |
| (D) | 42 | 1.944 | Inv. ex. |

Example 8

As samples, the steel sheets given a lamellar spacing of the surface layer of 29 μm after annealing the hot rolled sheets in Example 7 were used. The samples were cold rolled to a 0.22 mm thickness, then heated by heating rates of 10 to 200° C./s to 720° C., then heated by 10° C./s to a temperature of 830° C. for decarburization annealing, then annealed in an ammonia-containing atmosphere to increase the nitrogen in the steel sheet to 0.02%, then coated with an annealing separator mainly comprised of MgO, then final annealed.

The magnetic properties after final annealing of the samples with different heating rates obtained are shown in Table 8.

TABLE 8

| Sample | Heating rate (° C./s) | Magnetic flux density B8 (T) | Remarks |
|---|---|---|---|
| (A) | 10 | 1.881 | Comp. ex. |
| (B) | 50 | 1.919 | Inv. ex. |
| (C) | 100 | 1.933 | Inv. ex. |
| (D) | 200 | 1.925 | Inv. ex. |

Example 9

A slab containing, by mass %, Si: 3.3%, C: 0.055%, acid soluble Al: 0.027%, N: 0.008%, Mn: 0.1%, S: 0.007%, Cr: 0.1%, Sn: 0.05%, P: 0.03%, and Cu: 0.2% and having a balance of Fe and unavoidable impurities was heated to a temperature of 1150° C., then hot rolled to 2.3 mm thickness, then samples (A) were left as they were, while samples (B) were coated on their surfaces with $K_2CO_3$, and the samples were annealed in a dry atmospheric gas of nitrogen and hydrogen at a temperature of 1080° C. These samples were cold rolled to 0.22 mm thickness, then heated by a heating rate of 20° C./s to 550° C., heated by a heating rate of 100° C./s to 550 to 720° C., then heated by a heating rate of 15° C./s and decarburization annealed at a temperature of 840° C., then annealed in an ammonia-containing atmosphere to increase the nitrogen in the steel sheet to 0.022%, then coated with an annealing separator mainly comprising MgO, then final annealed.

The magnetic properties after final annealing of the obtained samples with different lamellar spacings of the surface layer are shown in Table 9.

TABLE 9

| Sample | Lamellar spacing (μm) | Magnetic flux density B8 (T) | Remarks |
|---|---|---|---|
| (A) | 15 | 1.874 | Comp. ex. |
| (B) | 25 | 1.943 | Inv. ex. |

Example 10

A silicon steel slab containing, by mass %, Si: 3.3%, C: 0.055%, acid soluble Al: 0.027%, and N: 0.008% and having a balance of Fe and unavoidable impurities was heated to a temperature of 1150° C., then hot rolled to 2.3 mm thickness, then annealed at 1110° C. At that time, steam was blown into the atmospheric gas (mixed gas of nitrogen and hydrogen) to cause the surface to decarburize and make the lamellar spacing of the surface layer 26 μm. These samples were cold rolled to a 0.22 mm thickness, then heated in an atmosphere comprised of nitrogen and hydrogen having an oxidation degree of 0.59 by a heating rate of 100° C./s to 720° C., then heated by 10° C./s to a temperature of 830° C. for decarburization annealing, then annealed in an ammonia-containing atmosphere to increase the nitrogen in the steel sheet to 0.008 to 0.026%, then coated with an annealing separator mainly comprised of MgO, then final annealed.

The magnetic properties after final annealing of the obtained samples with different amounts of nitrogen are shown in Table 10.

TABLE 10

| Sample | Lamellar spacing (μm) | Nitrogen amount (%) | N/Al | Magnetic flux density B8 (T) | Remarks |
|---|---|---|---|---|---|
| (A) | 26 | 0.009 | 0.33 | 1.622 | Comp. ex. |
| (B) | 26 | 0.011 | 0.41 | 1.815 | Comp. ex. |
| (C) | 26 | 0.016 | 0.59 | 1.916 | Inv. ex. |
| (D) | 26 | 0.023 | 0.85 | 1.928 | Inv. ex. |
| (E) | 26 | 0.026 | 0.96 | 1.933 | Inv. ex. |

Example 11

As samples, the cold rolled sheets of the sheet thickness of 0.22 mm used in Example 10 were heated in an atmospheric gas comprised of nitrogen and hydrogen with an oxidation degree of 0.67 by heating rates of 50° C./s to 750° C., then were heated by 15° C./s to a temperature of 780 to 830° C. for decarburization annealing, then annealed in an ammonia-containing atmosphere to increase the nitrogen in the steel sheet to 0.021%, then coated with an annealing separator mainly comprised of MgO, then final annealed.

The magnetic properties after final annealing of the obtained samples with different primary recrystallization grain sizes are shown in Table 11.

TABLE 11

| Sample | Soaking temperature (° C.) | Grain size | Magnetic flux density B8 (T) | Remarks |
|---|---|---|---|---|
| (A) | 780 | 14 | 1.853 | Comp. ex. |
| (B) | 800 | 20 | 1.919 | Inv. ex. |
| (C) | 820 | 23 | 1.929 | Inv. ex. |

Example 12

A silicon steel slab containing, by mass %, Si: 3.3%, C: 0.06%, acid soluble Al: 0.028%, N: 0.008%, Mn: 0.1%, S: 0.008%, Cr: 0.1%, and P: 0.03% and having a balance of Fe and unavoidable impurities was heated to a temperature of 1150° C., hot rolled to 2.3 mm thickness, then annealed in two stages of 1120° C.+920° C. and cold rolled to 0.22 mm thickness. Its cold rolled sheets were heated by a heating rate of (A) 15° C./s and (B) 50° C./s until temperatures of (1) 500° C., (2) 550° C., and (3) 600° C., then were heated by a heating rate of 100° C./s to 720° C. and further heated by 10° C./s to a temperature of 830° C. for decarburization annealing. Next, they were annealed in an ammonia-containing atmosphere to increase the nitrogen in the steel sheet to 0.024%, then coated with an annealing separator mainly comprised of MgO, then final annealed.

The magnetic properties after final annealing are shown in Table 12. By increasing the low temperature region heating rate, it is learned that excellent magnetic properties are obtained even if raising the start temperature for heating by 100° C./s to 600° C.

TABLE 12

| Sample | Low temperature region heating rate (° C./s) | 100° C./s heating start temperature | Magnetic flux density B8 (T) | Remarks |
|---|---|---|---|---|
| (A-1) | 15 | 500 | 1.944 | Inv. ex. |
| (A-2) | 15 | 550 | 1.942 | Inv. ex. |

TABLE 12-continued

| Sample | Low temperature region heating rate (° C./s) | 100° C./s heating start temperature | Magnetic flux density B8 (T) | Remarks |
|---|---|---|---|---|
| (A-3) | 15 | 600 | 1.901 | Comp. ex. |
| (B-1) | 50 | 500 | 1.945 | Inv. ex. |
| (B-2) | 50 | 550 | 1.943 | Inv. ex. |
| (B-3) | 50 | 600 | 1.943 | Inv. ex. |

INDUSTRIAL APPLICABILITY

The present invention uses low temperature slab heating to produce grain-oriented electrical steel sheet during which annealing the hot rolled sheet by two stages of temperature ranges so as to lower the upper temperature limit of the control range of the heating rate in the temperature elevation process of the decarburizing annealing, performed to improve the grain structure after the primary recrystallization after decarburization annealing, and to enable heating by only induction heating, so can perform that heating more easily using induction heating and can more stably produce grain-oriented electrical steel sheet high in magnetic flux density and superior in magnetic properties. For this reason, it has great industrial applicability.

The invention claimed is:

1. A method of production of grain-oriented electrical steel sheet comprising the steps of:

heating a silicon steel slab containing, by mass %, Si: 0.8 to 7%, C: 0.085% or less, acid soluble Al: 0.01 to 0.065%, and N: 0.012% or less at a temperature of 1280° C. or less, then hot rolling the heated slab into a hot rolled steel strip, annealing the hot rolled steel strip, then cold rolling the annealed steel strip once or several times with intermediate annealing to a final steel strip thickness, decarburization annealing the cold rolled steel strip, then coating an annealing separator, and applying final annealing, wherein the decarburization annealed steel strip is treated to increase nitrogen in the decarburization annealed steel strip from the decarburization annealing to the start of secondary recrystallization in the final annealing, characterized by:

performing the annealing of the hot rolled steel strip by heating to a predetermined temperature of 1000° to 1150° C. to cause recrystallization, then annealing the recrystallized steel strip at a temperature of 850° to 1100° C. to provide a grain structure having a lamellar spacing of 20 μm or more in the annealed recrystallized steel strip, and heating the cold-rolled steel strip during decarburization annealing in a heating process consisting of only induction heating at a heating rate of 40° C./s or more in a steel strip temperature range of 550° C. to 720° C.

2. A method of production of grain-oriented electrical steel sheet comprising the steps of:

heating a silicon steel slab containing, by mass %, Si: 0.8 to 7%, C: 0.085% or less, acid soluble Al: 0.01 to 0.065%, and N: 0.012% or less at a temperature of 1280° C. or less, then hot rolling the heated slab into a hot rolled steel strip, annealing the hot rolled steel strip, then cold rolling the annealed steel strip once or several times with intermediate annealing to a final steel strip thickness, decarburization annealing the cold rolled steel strip, then coating an annealing separator, and applying final annealing, wherein the decarburization annealed steel strip is treated to increase nitrogen in the decarburization annealed steel strip from the decarburization annealing to the start of secondary recrystallization in the final annealing, characterized by, in the annealing of the hot rolled sheet steel strip, decarburizing the hot rolled sheet steel strip to reduce the carbon content to 0.002 to 0.02 mass % of the amount of carbon present before decarburizing by means of controlling a $PH_2O/PH_2$ ratio in a moisture atmosphere or coating a decarburizing acceleration agent on the steel strip, and after annealing the hot-rolled steel strip, subjecting the annealed hot-rolled steel strip step to decarburization annealing to provide a surface layer grain structure having a lamellar spacing of 20 μm or more, and heating the cold rolled steel strip during decarburization annealing in a heating process consisting of only induction heating at a heating rate of 40° C./s or more in a steel strip temperature of 550° C. to 720° C.

3. A method of production of grain-oriented electrical steel sheet as set forth in claim 1, characterized by heating the cold rolled steel strip in the decarburization annealing step at a heating rate of 50° to 250° C./s in a temperature range of a steel strip temperature of 550° C. to 720° C.

4. A method of production of grain-oriented electrical steel sheet as set forth in claim 1, characterized by heating the cold rolled steel strip in the decarburization annealing step at a heating rate of 75° to 125° C./s in a temperature range of 550° C. to 720° C.

5. A method of production of grain-oriented electrical steel sheet as set forth in claim 1, characterized by performing said decarburization annealing in a time interval so that the amount of oxygen of the steel strip to be decarburized becomes 2.3 $g/m^2$ or less and the primary recrystallization grain size becomes 15 μm or more, in a temperature range of 770° to 900° C. under the conditions where the oxidation degree ($PH_2O/PH_2$) of the atmospheric gas is in a range of over 0.15 to 1.1.

6. A method of production of grain-oriented electrical steel sheet as set forth in claim 1, characterized by increasing the amount of nitrogen [N] of said decarburization annealed steel strip in accordance with an amount of acid soluble Al [Al] of the steel strip so as to satisfy the formula $[N] \geqq 14/27[Al]$.

7. A method of production of grain-oriented electrical steel sheet as set forth in claim 1, characterized by increasing the amount of nitrogen [N] of said decarburization annealed steel strip in accordance with an amount of acid soluble Al [Al] of the steel strip so as to satisfy the formula $[N] \geqq 2/3[Al]$.

8. A method of production of grain-oriented electrical steel sheet as set forth in claim 1, wherein said annealing separator mainly comprises alumina.

9. A method of production of grain-oriented electrical steel sheet as set forth in claim 1, characterized in that said silicon steel slab further contains, by mass %, one or more of Mn: 1% or less, Cr: 0.3% or less, Cu: 0.4% or less, P: 0.5% or less, Sn: 0.3% or less, Sb: 0.3% or less, Ni: 1% or less, and S and Se in a total of 0.015% or less.

10. A method of production of grain-oriented electrical steel sheet as set forth in claim 2, characterized by heating the cold rolled steel strip in the decarburization annealing step at a heating rate of 50° to 250° C./s in a temperature range of a steel strip temperature of 550° C. to 720° C.

11. A method of production of grain-oriented electrical steel sheet as set forth in claim 2, characterized by heating the cold rolled steel strip in the decarburization annealing step at a heating rate of 75° to 125° C./s in a temperature range of 550° C. to 720° C.

12. A method of production of grain-oriented electrical steel sheet as set forth in claim 2, wherein the annealing separator mainly comprises alumina.

13. A method of production of grain-oriented electrical steel sheet as set forth in claim 2, characterized in that said silicon steel slab further contains, by mass %, one or more of Mn: 1% or less, Cr: 0.3% or less, Cu: 0.4% or less, P: 0.5% or less, Sn: 0.3% or less, Sb: 0.3% or less, Ni: 1% or less, and S and Se in a total of 0.015% or less.

14. A method of production of grain-oriented electrical steel sheet as set forth in claim 2, characterized by performing said decarburization annealing in a time interval so that the amount of oxygen of the steel strip to be decarburized becomes 2.3 $g/m^2$ or less and the primary recrystallization grain size becomes 15 μm or more, in a temperature range of 770° to 900° C. under the conditions where the oxidation degree ($PH_2O/PH_2$) of the atmospheric gas is in a range of over 0.15 to 1.1.

15. A method of production of grain-oriented electrical steel sheet as set forth in claim 2, characterized by increasing the amount of nitrogen [N] of said decarburization annealed steel strip in accordance with an amount of acid soluble Al [Al] of the steel strip so as to satisfy the formula $[N] \geqq 14/27 [Al]$.

16. A method of production of grain-oriented electrical steel sheet as set forth in claim 2, characterized by increasing the amount of nitrogen [N] of said decarburization annealed steel strip in accordance with an amount of acid soluble Al [Al] of the steel strip so as to satisfy the formula $[N] \geqq 2/3 [Al]$.

* * * * *